US005421566A

United States Patent [19]

Morgan

[11] Patent Number: 5,421,566

[45] Date of Patent: Jun. 6, 1995

[54] HOLDING DEVICE

[76] Inventor: Lester A. Morgan, 8988 South, 475 East, St. Paul, Ind. 47272

[21] Appl. No.: 187,227

[22] Filed: Jan. 27, 1994

[51] Int. Cl.[6] ..... B25B 1/02

[52] U.S. Cl. ..... 269/221; 269/275

[58] Field of Search ..... 269/88, 113, 219, 220, 269/221, 900, 224, 275, 277, 271, 273, 274, 279

[56] References Cited

U.S. PATENT DOCUMENTS

| | | | |
|---|---|---|---|
| 416,244 | 12/1884 | Weller | 269/221 |
| 893,875 | 7/1908 | Schneider | 269/88 |
| 2,498,696 | 2/1950 | Middaugh | 269/221 |
| 3,025,521 | 3/1962 | Polk | 269/113 |
| 3,599,961 | 8/1971 | Morgan | 269/275 |
| 4,125,251 | 11/1978 | Jamieson | 269/900 |

*Primary Examiner*—Robert C. Watson
*Attorney, Agent, or Firm*—Barnes & Thornburg

[57] ABSTRACT

The invention is drawn to fixture stock for producing holding devices. The fixture stock is made from an elongated base plate having side rails along two parallel opposed longitudinal edges to define an intermediate, longitudinally extending space therebetween. An elongated jaw plate is disposed above the base plate and between the side rails and an elongated pad of resilient material is sandwiched between the base and jaw plates, which in turn are bonded to opposite sides of the pad respectively, whereby the base and jaw plates are resiliently connected for slight relative movement. The side rafts include a plurality of anchoring holes perpendicular to the base plate and extending through the base plate, and the side rails also include a plurality of thrusting holes parallel to the base plate and extending through the side rails toward the jaw plates. Preferably the jaw plate is split into a pair of separate portions, separated from each other by a filler strip.

5 Claims, 4 Drawing Sheets

HOLDING DEVICE

BACKGROUND AND SUMMARY OF THE INVENTION

The present invention relates to a holding device, and in particular to a holding device as used in machining operations. More particularly, the present invention relates to a holding device which can firmly hold delicate parts without damaging them while preventing movement or tilt of the parts during machining operations. In addition, the holding device that this invention relates to can easily be made from a prefabricated composite bar produced for this purpose.

Machine parts are typically formed with automatic equipment that operates at dangerous speeds and power. The operating forces which are present in this equipment and which are transferred to parts being formed make it impossible to hold these parts unaided while work is in progress. It is common to find vices and other clamping mechanisms in machine shops for holding parts as they are processed.

Most vices, however, include two flat walls between which parts are held. Therefore, vices are most effective when holding parts that include opposing parallel flat surfaces. Many standard clamping mechanisms include jaws designed to hold parts that do not have opposing parallel flat surfaces, however the range of shapes that can be securely held by these standard devices is limited.

It is known to form a holding device that can securely hold parts with odd shapes. For example, Morgan U.S. Pat. No. 3,599,961 shows a holding device formed by bonding a first rigid plate to a pad of resilient material such as neoprene, bonding a second rigid plate to the opposite side of the pad so that there is slight relative movement between the plates, cutting the second rigid plate in half to form opposing jaws for gripping, then forming a cutout in the opposing jaws to match the shape of the part to be held.

The machining equipment in machine shops is typically expensive and workers are typically paid an hourly rate, so it is important to maximize the productivity of the workers and the equipment. If the equipment is broken or is not producing product for some other reason, then the machine shop's capacity is impaired and it must either purchase more equipment than would otherwise be required or sell less product. One problem that reduces the run time of this equipment is set-up time. Each time a machine table load of parts is worked and completed, the machine must be shut down so that the completed parts can be removed from the table and additional parts can be loaded. If bulky clamping devices are employed for holding parts for this operation, fewer parts can be loaded onto the table and fewer parts can be worked on between set-ups. As the number of parts that may be loaded onto the table decreases, the necessary set-up time increases, reducing the run time and thus the capacity of the machine shop equipment.

For the foregoing reasons, there is a need for an improved compact holding device that can securely hold parts with irregular shapes, that can securely hold fragile parts without damaging them, and that can be readily produced in most machine shops.

SUMMARY

The present invention is directed to a holding device that is easy to produce and which maximizes the number of parts that can be loaded onto a machine table at one time, while being capable of securely holding irregularly shaped fragile parts without damaging them. A holding device having features of the present invention comprises an elongated base plate having opposed longitudinal edges and an upwardly facing plane surface, longitudinally extending side rails rigidly fastened to each of the longitudinal edges of the base plate, a pair of longitudinally extending jaw plates above the base plate and between the side rails, and a pad of resilient material sandwiched between the base plate and the jaw plates. The base plate and jaw plates are bonded to opposite sides of the pad, so that the plates are resiliently connected for slight relative movement.

If desired, the facing edges of the pair of portions of the first plate may be provided with cutouts to match the shape of an irregular object to be held. For applications in which no downward movement of the jaw plates can be tolerated, the bonding surfaces of the jaw plates can include a plurality of feet in movable contact with the base plate.

If the part to be held is fragile, relative movement of the jaw plates toward each other may be controlled to prevent damage to the part. In an illustrative and preferred embodiment, this control is accomplished by establishing a gap between the facing edges of the jaw plates at a specific predetermined distance while the cutout is formed. This gap will limit the range of movement of the jaws when directed toward each other, eliminating the possibility of damage to fragile parts.

Machine shops and factories can be provided with a composite bar that can be cut into smaller sections as desired and each section can then be readily converted into a holding device having desirable properties. The preferred composite bar is a presplit fixture stock which includes a base plate that extends across the breadth of the stock. One side rail is mounted on one edge of the top side of the base plate and a second side rail is mounted on the other edge of the top side of the base plate. The side rails both include a plurality of anchoring holes perpendicular to the base plate and extending through the base plate. The side rails and anchoring holes may be spaced so that the distance between one anchoring hole and any other anchoring hole on the preferred composite bar is a multiple of one inch. The side rails also include a plurality of thrusting holes parallel to the base plate and extending through the width of the side rails. A pad of resilient material such as neoprene is bonded to the top side of the base plate between the side rails. The edge of the pad touches each side rail. A grip assembly, including two gripper bars and a shim strip between the gripper bars, is mounted on the resilient pad between the two side rails. The spacing is such that the grip assembly is snug between the side rails.

This above-described presplit fixture stock can be readily and easily cut into sections and each section can then be readily and easily converted into a holding device by simple machining operations. The holding devices produced with the presplit fixture stock utilize the resiliency of the pad sandwiched between the plates of a section of the stock.

The anchoring holes in the side rails permit anchoring the devices to the machine table in a manner that minimizes the space required to complete this anchoring, thus maximizing table loading that may be achieved. Because there is no uniform standard for the spacing of T-slots typically used for anchoring devices to machine tables, in a preferred and illustrative embodiment, a master plate is used for anchoring these holding devices to machine tables. The master plate is provided with countersunk T-bolts that protrude from the master plate bottom side. These T-bolts are spaced to match the T-slot spacing found on the machine table and are used to anchor the master plate to the table. The master plate top side includes a plurality of threaded holes, spaced at the appropriate dimensions to accept the holding devices, preferably as a matrix of threaded holes spaced at one inch increments across the top side of the master plate.

The thrusting holes in the side rails provide a compact means for drawing the gripper bars together. The shim between the gripper bars establishes a predetermined spacing between the gripper bars. After the gripper bars are provided with cutouts to match the shape of the object to be held, the shim between the gripper bars may be removed, creating a uniform gap between the gripper bars. This gap is the maximum distance that the gripper bars may move relative to one another when drawn together. This restriction prevents damage to fragile parts when they are held.

The method of this invention, therefore, comprises the steps of providing such a composite bar of presplit fixture stock, cutting the composite bar to the desired length to provide a section thereof, installing threaded fastening devices into the side bar holes parallel to the base plate to provide moderate pressure against the gripper bars, cutting the gripper bars to provide a socket for receiving a part so that each of the gripper bars provides a perimetral portion of the socket, and removing the shim between the gripper bars to permit relative movement of the gripper bars during use. This method will be more fully discussed as this description progresses.

In this description and in the claims appended hereto, the terms "rigid plate" and "bars" are to be considered synonymous. Further, the term "a pad of resilient material" is to be considered as any type of rubber or rubber-like pad or strip. Still further, the term "bonded" is to be considered as any type of connection between a rigid member, such as a metal bar, and a resilient member, such as a rubber or rubber-like pad.

To the accomplishment of the above and related objects, this invention may be embodied in the forms illustrated in the accompanying drawings and described herein, attention being called to the fact, however, that the drawings and description are illustrative only, and that change may be made in the specific constructions illustrated and described or in the specific steps stated, so long as the scope of the claims is not violated.

DETAILED DESCRIPTION OF THE DRAWINGS

Figure 1:
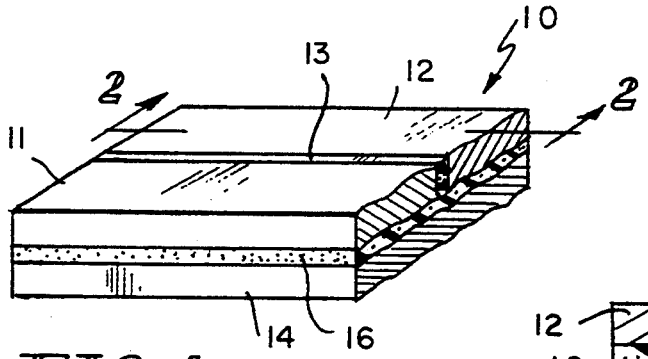
FIG. 1 is a fragmentary perspective view of a composite bar in accordance with the present invention.
Figure 2:
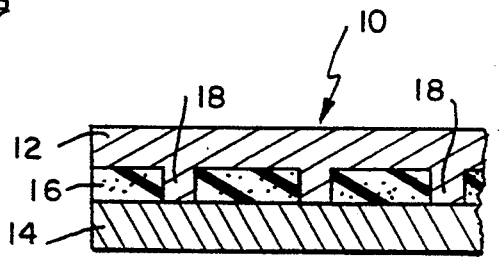
FIG. 2 is a cross section taken along lines 2—2 of FIG. 1 to show the feet that are attached to the top plate to prevent movement of the top plate toward the bottom plate.

A composite bar 10 comprising a base plate 14, two jaw plates 11 and 12, a filler strip 13, and a resilient strip 16 sandwiched between the base plate 14 and the jaw plates 11 and 12 and the filler strip 13, as shown in FIG. 1, is the illustrative basis of this invention. This composite bar 10 will preferably be provided in mill lengths. The plates 11, 12 and 14 are elongated, flat and parallel, with the jaw plates 11 and 12 and the filler strip 13 being superimposed above the base plate 14. The resilient strip 16 is likewise elongated and flat and preferably of the same width as the base plate 14 and jaw plates 11 and 12. The base plate 14 is bonded to the underneath side of the strip 16 and the plates 11 and 12 are bonded to the upper side of the strip 16. For applications in which no downward movement of the jaw plates 11 and 12 can be tolerated, the bonding surfaces of the jaw plates 11 and 12 include a plurality of feet 18 in contact with the base plate 14, as shown in FIG. 2.

In some cases, it is preferable that the plate 14 be cold-rolled steel and that the plates 11 and 12 be aluminum. In such a case, it is preferable that the strip 16 be, for instance, 65–75 durometer neoprene rubber which is heat bonded with standard vulcanizing techniques to the plates 11, 12 and 14. Such bonding techniques are well known and do not need to be discussed in detail in this description. The lower steel bar 14 can, of course, be used with magnetic chucks or holding devices conventionally provided on machining systems. The upper aluminum jaw plates 11 and 12 are easy to machine and will not rust during storage.

The composite bar 10 may be provided in varying widths and thicknesses. For instance, each of the plates 11, 12 and 14 may be one-fourth inch thick while the strip 16 is one-sixteenth inch thick. This thickness of the strip 16 will permit a small section of the plates 11 and 12 to be moved slightly relative to the bar 14. That is, if a small section of the composite bar 10 is cut from the bar, the upper plates 11 and 12 of this small section can move slightly relative to the lower plate 14 of the section, and such movement will occur generally in a plane which is parallel to the plate 14.

Figure 3:
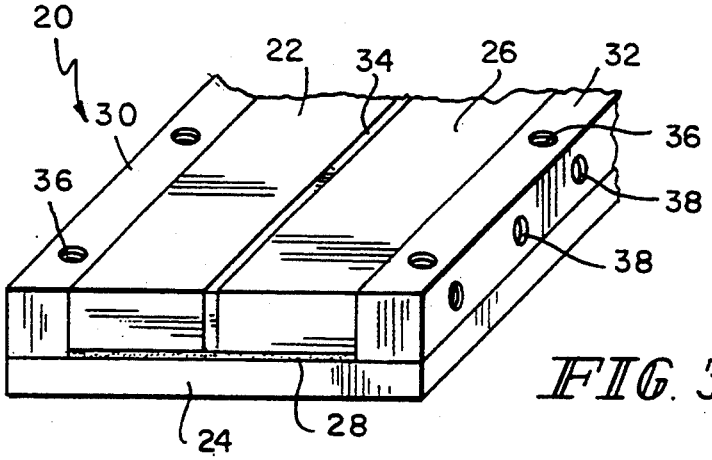
FIG. 3 is a perspective view of a portion of a presplit fixture stock that is ready to be mounted to a machining table and formed into a holding device.

A presplit fixture stock 20 comprises a first rigid plate 22, a second rigid plate 24, a third rigid plate 26, and a pad of resilient material 28 sandwiched between the first plate 22 and the second plate 24, and between the third plate 26 and the second plate 24, the first plate 22 and the third plate 26 being bonded to the same side of the pad and the second plate 24 being bonded to the opposite side of the pad is shown in FIG. 3, as an embodiment of this invention. The second plate 24 is wider, extending laterally beyond the pad 28, and beyond the plates 22 and 26. A first side rail 30 and a second side rail 32 are mounted to the laterally extended portions of the second plate 24. The first plate 22 is disposed adjacent side rail 30, the third plate 26 is disposed adjacent side rail 32, and a filler strip 34 is disposed between and in contact with the first plate 22 and the third plate 26. The side rails 30 and 32 include anchoring holes 36 and thrusting holes 38. The anchoring holes 36 extend through the second plate 24. The thrusting holes 38 extend through the side rails 30 and 32.

Figure 5A:
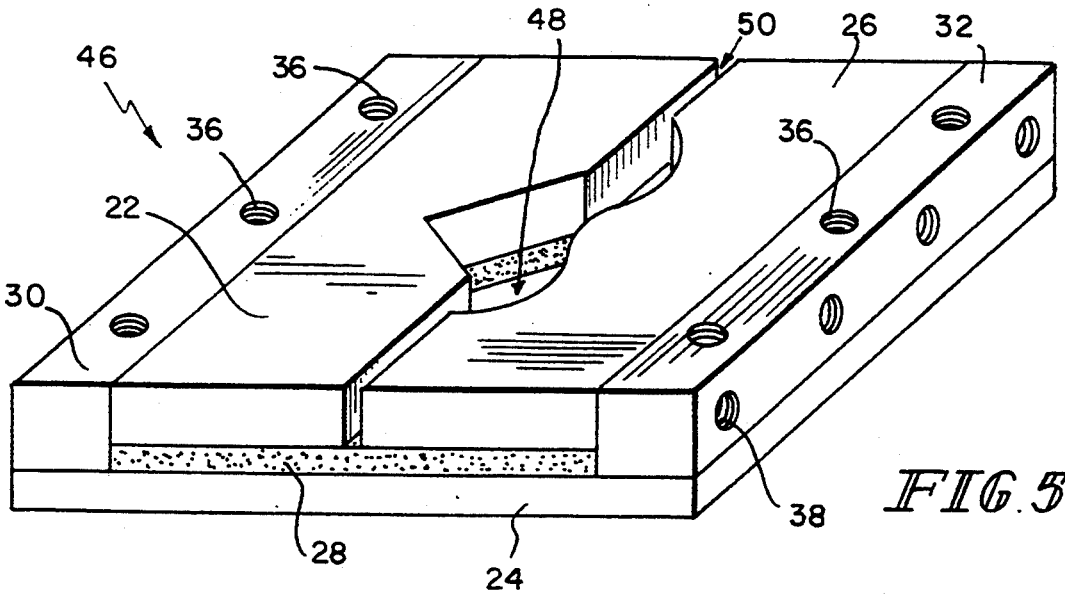
FIG. 5*a* is a perspective view of a holding device produced from the presplit fixture stock of FIG. 3 and designed to hold an irregularly shaped object.

A holding device 46, shown in FIG. 5*a*, is produced from presplit fixture stock 20 by obtaining a section of presplit fixture stock 20 sized according to the requirements of the part to be held (the part to be held is not shown), bolting the section of presplit fixture stock 20 to a standard machining table using the anchoring holes 36, installing screws into the threaded thrusting holes 38 to bring moderate pressure against the plates 22 and 26, cutting a pocket 48 of the shape of the part to be held into the plates 22 and 26, releasing the screws in the thrusting holes 38, and removing the filler strip 34.

The gap 50 formed when the filler strip 34 is removed establishes the maximum relative movement between the first plate 22 and the third plate 26. A part to be held can be placed into the pocket 48. Engaging the screws in the thrusting holes 38 to bring pressure against the part will cause the part to be held securely.

Figure 4:
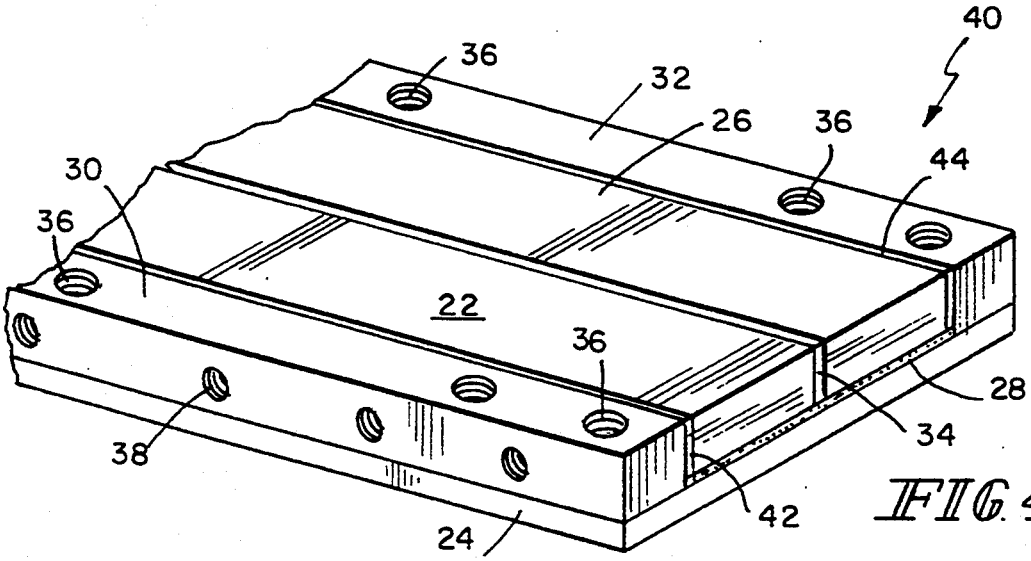
FIG. 4 is a fragmentary perspective view of a presplit fixture stock with thin filler strips next to the outside rails.

Another presplit fixture stock 40, which is an embodiment of this invention shown in FIG. 4, comprises a first rigid plate 22, a second rigid plate 24, a third rigid plate 26, a pad of resilient material 28, a first side rail 30, a second side rail 32, the side rails 30 and 32 including anchoring holes 36 and thrusting holes 38, the plates 22, 24 and 26, the pad 28 and the side rails 30 and 32 configured identically to the presplit fixture stock shown in FIG. 3 with the addition of a first shim 42 disposed between the first side rail 30 and the first rigid plate 22, and a second shim 44 disposed between the second side rail 32 and the third rigid plate 26. In addition, drawing holes 61 are included in the first plate 22 and the third plate 26, as best shown in FIG. 5*c*, so that, for example, a screw installed into a thrusting hole 38 in the first side rail 30 after the shim 42 is removed will engage a drawing hole 61 in the first plate 22, drawing the first plate 22 toward the side rail 30.

Figure 5B:
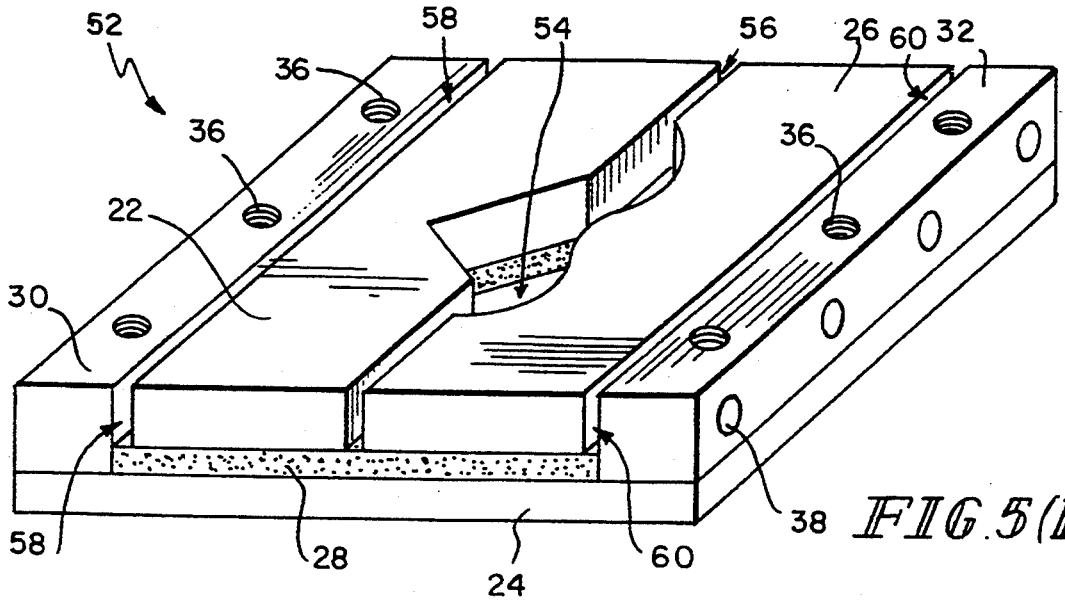
FIG. 5*b* is a perspective view of a holding device produced from the presplit fixture stock of FIG. 4 and designed to hold an irregularly shaped object.
Figure 5C:
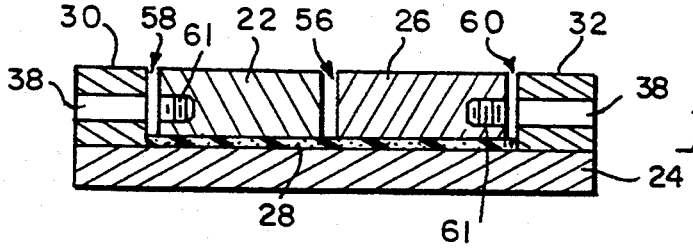
FIG. 5*c* is a sectional view of the holding device of FIG. 5*b* showing threaded holes in the jaw plates to permit withdrawing the plates while the pocket is formed.

A holding device 52, shown in FIG. 5*b*, is produced from presplit fixture stock 40 by obtaining a section of presplit fixture stock 40 sized according to the requirements of the part to be held (the part to be held is not shown), removing the shims 42 and 44, installing screws into the thrusting holes 38 and the drawing holes 61, drawing plates 22 and 26 apart, cutting a pocket 54 of the shape of the parts to be held into the plates 22 and 26, disengaging the screws in the thrusting holes 38, and removing the filler strip 34.

The gap 56 formed when the filler strip 34 is removed establishes the maximum relative movement of the first plate 22 and the third plate 26 toward each other. The gaps 58 and 60 establish the maximum relative movement of the first plate 22 and the third plate 26 away from each other. Installing screws in the thrusting holes 38 and the drawing holes 61 will draw the first plate 22 and the third plate 26 apart, so that placing a part into the pocket 54 and disengaging the screws in the thrusting holes 38 will bring pressure against the part causing the part to be held securely. In most applications, however, it is not necessary to install screws into the holes 38 and 61 when removing and placing parts into the pocket 54. In these applications, the action of removing or placing parts into the pocket 54 will force the first plate 22 and third plate 26 apart as required.

This invention can be manifested in several additional embodiments. Some of these embodiments are displayed in FIGS. 6 through 11 and are discussed below.

Figure 6:
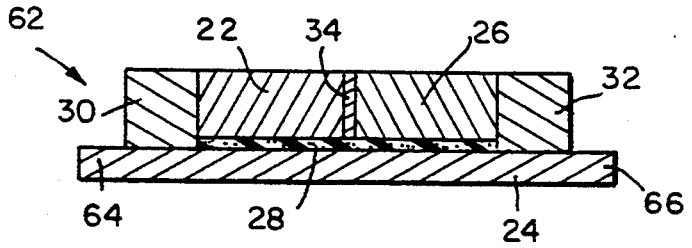
FIG. 6 is a sectional view of a holding device similar to those shown in FIG. 5, except that the base has been extended for bolting to tables or master plates.

Referring now to FIG. 6, a holding device 62 will be discussed. The difference between device 62 and devices 46 and 52 of FIGS. 5*a* and 5*b* is that the second plate 24 on device 62 has a first extension 64 beyond the first side rail 30 and a second extension 66 beyond the second side rail 32. This configuration permits the use of extensions 64 and 66 to bolt the holding device 62 to tables or master plates without using toe clamps.

Figure 7:
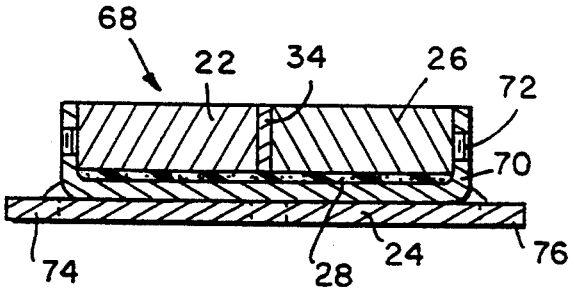
FIG. 7 is a sectional view of a holding device similar to that shown in FIG. 6 except that heavy gauge steel is used to fabricate the stock by forming a channel and welding it to a base plate.

Referring now to FIG. 7, another holding device 68 will be discussed. This holding device 68 comprises a channel 70 welded to a base plate 24, with a first rigid plate 22 and a third rigid plate 26 disposed above the channel. A pad of resilient material 28 is sandwiched between the first plate 22 and the channel 70, and between the third plate 26 and the channel 70. The first plate 22 and the third plate 26 are bonded to the same side of the pad 28 and the channel 70 is bonded to the opposite side of the pad 28. A filler strip 34 is disposed between the plates 22 and 26. The channel 70 includes thrusting holes 72 extending through the channel 70 and parallel to the base plate 24. The base plate 24 has a first extension 74 beyond the channel 70 on the side of the first plate 22, and a second extension 76 beyond the channel 70 on the side of the third plate 26. This configuration permits the use of extensions 74 and 76 to bolt the holding device 68 to tables or master plates. Slots could be included in the extensions 74 and 76 to accept tie down bolts. In a preferred embodiment, the channel 70 and the base plate 24 are fabricated from heavy gauge strip steel.

Figure 8:
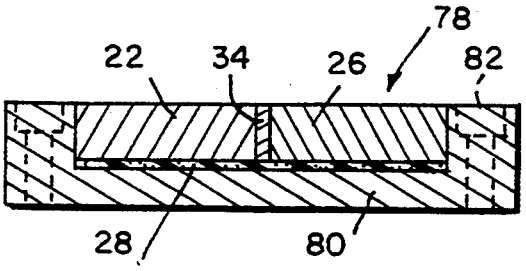
FIG. 8 is a sectional view of a holding device similar to that shown in FIG. 7, except that there is no base plate and aluminum is used to fabricate the stock using an extruded aluminum channel.

Referring now to FIG. 8, another holding device 78 will be discussed. This holding device 78 comprises a channel 80, with a first rigid plate 22, and a third rigid plate 26 disposed above the channel. A pad of resilient material 28 is sandwiched between the first plate 22 and the channel 80, and between the third plate 26 and the channel 80. The first plate 22 and the third plate 26 are bonded to the same side of the pad 28 and the channel 80 is bonded to the opposite side of the pad 28. A filler strip 34 is disposed between the plates 22 and 26. The channel 80 includes anchoring holes 82. In a preferred embodiment, the channel 80 is extruded aluminum and the plates 22 and 26 are aluminum.

Figure 9:
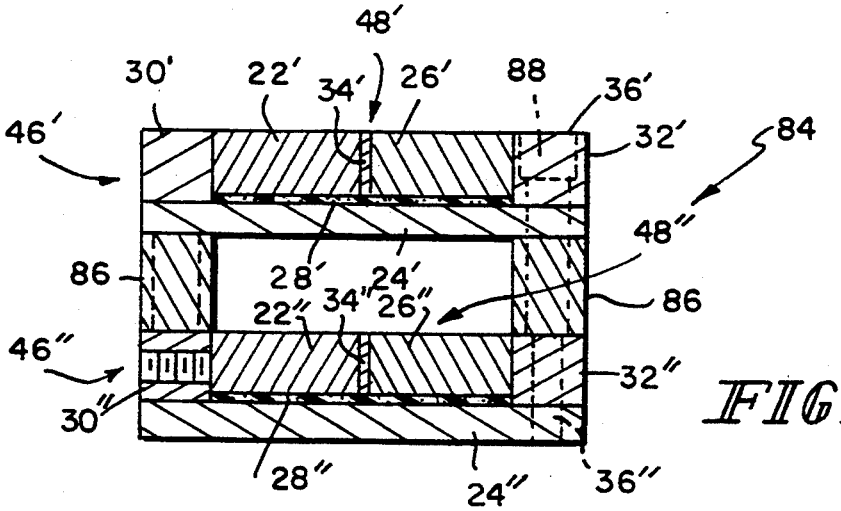
FIG. 9 is a sectional view of a holding device in which stand-off blocks are used to join together two holding devices similar to the holding device in FIG. 5 making the system three dimensional and capable of clamping parts that are tall.

Referring now to FIG. 9, another holding device 84 will be discussed. This holding device 84 comprises two holding devices 46' and 46'' which are similar to holding device 46 in FIG. *5a*, and which are connected by stand-off blocks 86. As shown in FIG. 9, the base plate 24' of holding device 46' is mounted over the first plate 22'' and third plate 26'' of holding device 46''. The stand-off blocks 86 are disposed between the anchoring holes 36' of holding device 46' and the anchoring holes 36'' of holding device 46'' so that bolts 88 inserted into anchoring holes 36' engage anchoring holes 36'' through the stand-off blocks 86. When a pocket 48' is formed in the first plate 22' and the third plate 26', a corresponding cutout is required in the resilient pad 28' and the base plate 24' of the holding device 46'. A pocket 48'' will also be required for the first plate 22'' and the third plate 26'' of the holding device 46''. The holding device 84 is useful for securely holding tall parts.

Figure 10:
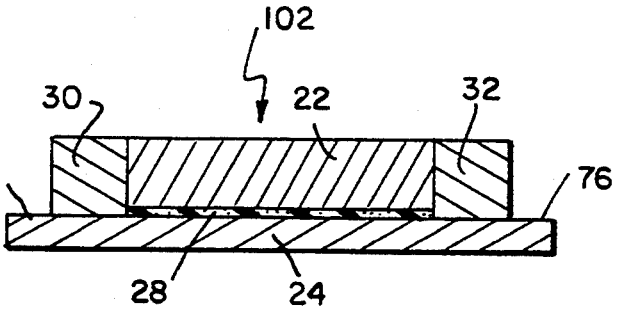
FIG. 10 is a sectional view of fixture stock similar to that shown in FIG. 3, except that there is no split in the center, for applications where numerous small parts may be lined up in more than one row, or for applications in which the split lines are off-center, in which cases the split lines are established when the holding device is formed.

Referring now to FIG. 10, another holding device 102 which is similar to device 62 (FIG. 6) will be discussed. Device 102 is comprised of a first rigid plate 22 and a second rigid plate 24, with a pad of resilient material 28 sandwiched between the plates 22 and 24. The plates are bonded to opposite sides of the pad 28. The plate 24 is elongated, a side rail 30 is mounted to the one side portion of plate 24 disposed adjacent the first plate 22 and the pad 28, and an opposite side rail 32 is mounted to the opposite side portion of plate 24 disposed adjacent the first plate 22 and the pad 28. The plate 24 includes a one side extension 74 and an opposite side extension 76, the extensions extending beyond the one side rail 30 and the opposite side rail 32. Where device 62 includes a third rigid plate 26 and a filler strip 34, device 102 is not presplit. This holding device is useful for applications where numerous small parts may be lined up in more than one row, or where the split line needs to be irregularly shaped or formed off-center, in which case the split lines are produced by the user when the holding device is formed.

Figure 11:
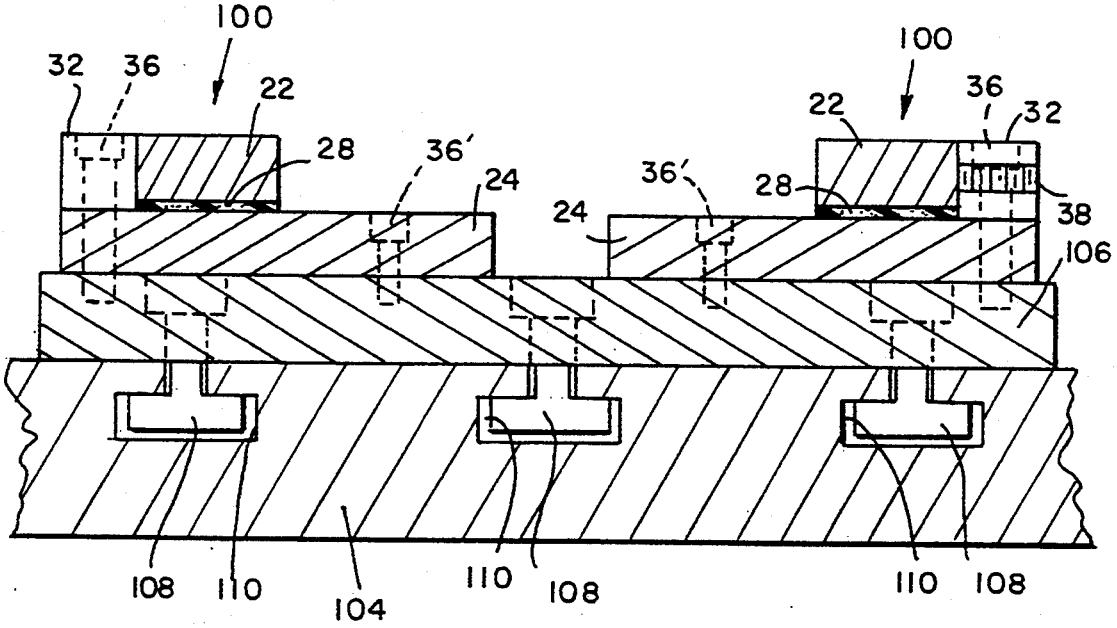
FIG. 11 is a sectional view of two holding devices similar to that shown in FIG. 5, except that one of the jaws has been removed from each device to permit holding large work pieces, the devices are shown mounted to a master plate.

Referring now to FIG. 11, another holding device 100 will be discussed. This holding device 100 comprises a second rigid plate 24 with a side rail 32, the side rail 32 being mounted adjacent one end portion of the top side of plate 24. A first rigid plate 22 is disposed above the second rigid plate 24, and a pad of resilient material 28 is sandwiched between the plates 22 and 24. The plates are bonded to opposite sides of the pad 28 with the pad 28 and plate 22 being bonded to the top side of plate 24. The plate 24 is elongated and the plate 22 and pad 28 are disposed adjacent the side rail 32. The side rail 32 includes thrusting holes 38 which extend through the side rail 32, and anchoring holes 36 which extend through the base plate 24. The plate 24 includes anchoring holes 36' in the portion of the plate 24 that is not bonded to the pad 28 and which does not include side rail 32. This half jaw holding device 100 is suited for working on large parts when used in conjunction with one or more additional half jaw holding devices 100 on the machine table 104. FIG. 11 shows two half jaw holding devices 100 mounted on a master plate 106 which is secured to a machine table 104 by standard T-bolts 108 spaced to fit into T-slots 110 in the machine table 104.

The above described devices 46, 52, 62, 68, 78, 84, 100, 102, composite bar 10, presplit fixture stocks 20 and 40, and fixture stocks described along with devices 62, 68, 78, 84, 100 and 102 will provide a machine shop with an improved means for making special tooling for manufacturing machine parts.

I claim:

1. A fixture stock for producing holding devices, the fixture stock comprising:

an elongated base plate having opposed longitudinal edges;

a pair of elongated side rails rigidly attached to the base plate, each side rail extending along an opposed edge of the base plate to define an intermediate, longitudinally extending space therebetween;

an elongated jaw plate disposed above the base plate and between the side rails;

an elongated pad of resilient material sandwiched between the base plate and the jaw plate, the plates being bonded to opposite sides of the pad, whereby the plates are resiliently connected for slight relative movement;

the side rails including a plurality of anchoring holes perpendicular to the base plate and extending through the base plate, and the side rails including a plurality of thrusting holes parallel to the base plate and extending through the side rails toward the jaw plates.

2. The fixture stock of claim 1, wherein the jaw plate is split into a pair of separate portions, each of which is resiliently connected to the base plate by the pad.

3. The fixture stock of claim 2, including a filler strip, the filler strip disposed between the pair of portions of the jaw plate.

4. The fixture stock of claim 3, including two shim strips, one shim strip disposed between one portion of the jaw plate and one side rail, the second shim strip disposed between the opposite portion of the jaw plate and the opposite side rail, the pair of portions of the jaw plate including a plurality of threaded drawing holes adjacent the side rails and aligned with the thrusting holes so that a threaded fastening element inserted into a thrusting hole will engage a drawing hole.

5. The fixture stock of claim 1, wherein the slight relative movement is caused by relative lateral movement of the plates and wherein means are provided for limiting the movement of the plates closer to one another.

* * * * *